US010917940B2

(12) United States Patent
Moriyama

(10) Patent No.: US 10,917,940 B2
(45) Date of Patent: Feb. 9, 2021

(54) VACUUM PUMP AND PUMP-INTEGRATED POWER SOURCE DEVICE

(71) Applicant: SHIMADZU CORPORATION, Kyoto (JP)

(72) Inventor: Nobuhiko Moriyama, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 325 days.

(21) Appl. No.: 15/920,510

(22) Filed: Mar. 14, 2018

(65) Prior Publication Data

US 2018/0279415 A1 Sep. 27, 2018

(30) Foreign Application Priority Data

Mar. 27, 2017 (JP) ..... 2017-060632

(51) Int. Cl.

| | |
|---|---|
| ***H05B 1/02*** | (2006.01) |
| ***F04D 19/04*** | (2006.01) |
| ***F04D 29/58*** | (2006.01) |
| ***F04D 25/06*** | (2006.01) |

(52) U.S. Cl.

CPC ..... *H05B 1/0247* (2013.01); *F04D 19/042* (2013.01); *F04D 29/582* (2013.01); *F04D 29/584* (2013.01); *F04D 25/06* (2013.01)

(58) Field of Classification Search

CPC .... F04D 19/042; F04D 29/584; F04D 29/582; F04D 25/06; H05B 1/0247

See application file for complete search history.

(56) References Cited

U.S. PATENT DOCUMENTS

2002/0039533 A1* 4/2002 Miyamoto ..... F04D 19/042 417/313
2005/0110819 A1* 5/2005 Kim ..... B41J 2/04563 347/17
2010/0247350 A1* 9/2010 Nagano ..... F04B 35/045 417/410.1

(Continued)

FOREIGN PATENT DOCUMENTS

CN 105443404 A 3/2016
CN 205371023 U 7/2016
JP 1998205486 A 8/1998

(Continued)

OTHER PUBLICATIONS

Office Action for corresponding Chinese Application No. 201810008472X, date unknown.

(Continued)

*Primary Examiner* — Bryan M Lettman
(74) *Attorney, Agent, or Firm* — Renner, Otto, Boisselle & Sklar, LLP

(57) ABSTRACT

A vacuum pump includes a pump device including a pump motor, an exhaust function section configured to exhaust sucked gas, and at least two direct current heaters, and a pump-integrated power source device. The pump-integrated power source device includes a pump control section, a pump power source configured to supply power to the pump control section, a direct current heater control section configured to control the two direct current heaters, and a direct current heater power source configured to supply power to the direct current heater control section.

13 Claims, 8 Drawing Sheets

(56) References Cited

U.S. PATENT DOCUMENTS

2015/0354577 A1* 12/2015 Tsutsui ..... F04D 29/32
415/90

FOREIGN PATENT DOCUMENTS

| | | | |
|---|---|---|---|
| JP | 2002285993 | A | 10/2002 |
| JP | 2004270692 | A | 9/2004 |
| JP | 2009156096 | A | 7/2009 |
| JP | 2013-79602 | A | 5/2013 |
| JP | 2015059464 | A | 3/2015 |

OTHER PUBLICATIONS

Office Action for corresponding Chinese Application No. 201810008472X, dated Aug. 2, 2019.
Notice of Reasons for Refusal for corresponding Japanese Patent Application No. 2017-060632 dated Jun. 2, 2020, with English translation.
Office Action for corresponding Chinese Patent Application No. 201810008472.X dated Jul. 1, 2020, with English translation.

* cited by examiner

VACUUM PUMP AND PUMP-INTEGRATED POWER SOURCE DEVICE

BACKGROUND OF THE INVENTION

1. Technical Field

The present invention relates to a vacuum pump and a pump-integrated power source device.

2. Background Art

In a device configured to perform CVD film formation or etching after the inside of a chamber has been brought into high vacuum by a turbo-molecular pump, a product easily adheres, depending on the type of gas to be exhausted, to the inside of the pump due to gas condensation in the pump. When such product adherence is caused, a disadvantage such as rotor balance degradation is caused. For this reason, a turbo-molecular pump has been known, which is configured to heat a pump main body by a heater to reduce product adherence (see, e.g., Patent Literature 1 (JP-A-2013-79602)).

In the turbo-molecular pump described in the above-described patent literature, alternating current power is supplied to the heater to generate heat from the heater. Generally, a heater drive circuit using the alternating current power is connected to an AC 200 V power source line, and applies an alternating current drive power of 200 V to the heater through an electric leakage detection circuit, a relay, a current sensor, and a fuse arranged in series.

Multiple heating target portions are sometimes heated by a plurality of heaters. In the case of using the plurality of heaters, a drive circuit needs to be provided for each heater. However, the heater drive circuit using the alternating current power needs to be provided with the electric leakage detection circuit, the relay, the current sensor, and the fuse as described above. For this reason, when the plurality of heater drive circuits is provided, it is difficult to downsize a power source device of the turbo-molecular pump.

SUMMARY OF THE INVENTION

A vacuum pump comprises: a pump device including a pump motor, an exhaust function section configured to exhaust sucked gas, and at least two direct current heaters; and a pump-integrated power source device including a pump control section, a pump power source configured to supply power to the pump control section, a direct current heater control section configured to control the two direct current heaters, and a direct current heater power source configured to supply power to the direct current heater control section.

The pump device further includes an alternating current heater, and the power source device includes an alternating current heater control section configured to control the alternating current heater.

A noise filter is provided at a common high-power line connected to a first high-power line for supplying power to the alternating current heater control section, a second high-power line for supplying power to the pump power source, and a third high-power line for supplying power to the direct current heater power source.

The vacuum pump further comprises: a pump housing forming the pump device; a power source device housing forming the power source device; and a cooling device interposed between the pump housing and the power source device housing. The pump control section and the direct current heater control section are attached to the cooling device.

In addition to the two direct current heaters, the pump device is further provided with one or more direct current heater.

The pump device further includes an exhaust pipe, and the alternating current heater is a heater configured to control the temperature of the exhaust pipe and provided at the outer periphery of the exhaust pipe.

The pump device further includes a stationary blade, a pump case and a base, and the two direct current heaters are a heater configured to control the temperature of stationary blade and provided at the outer periphery of the pump case, and a heater configured to control the temperature of the base and provided at the outer periphery of the base.

The heating temperature of the heater attached to the exhaust pipe is set higher than the heating temperature of the heater attached to the pump case and the heating temperature of the heater attached to the base.

The pump device further includes a stationary blade, a pump case and a base, and the two direct current heaters are a heater configured to control the temperature of stationary blade and provided at the outer periphery of the pump case, and a heater configured to control the temperature of the base and provided at the outer periphery of the base.

The DC heater control section has two FETs configured to control heater drive power to be supplied to the two DC heaters, and two shunt resistors for current detection.

The two DC heaters and the DC heater control section are connected together through a connector provided at the pump device, a connector provided at the pump-integrated power source device, and a cable connecting between the two connectors.

The AC heater control section has an electric leakage detection circuit connected to an AC high-power line, a relay, a current sensor, and a fuse.

A pump-integrated power source device used for the vacuum pump.

According to the present invention, the power source device can be downsized. The vacuum pump integrated with the power source device can be downsized.

DETAILED DESCRIPTION OF THE EXEMPLARY EMBODIMENTS

Hereinafter, embodiments of the present invention will be described with reference to the drawings.

First Embodiment

Figure 1:
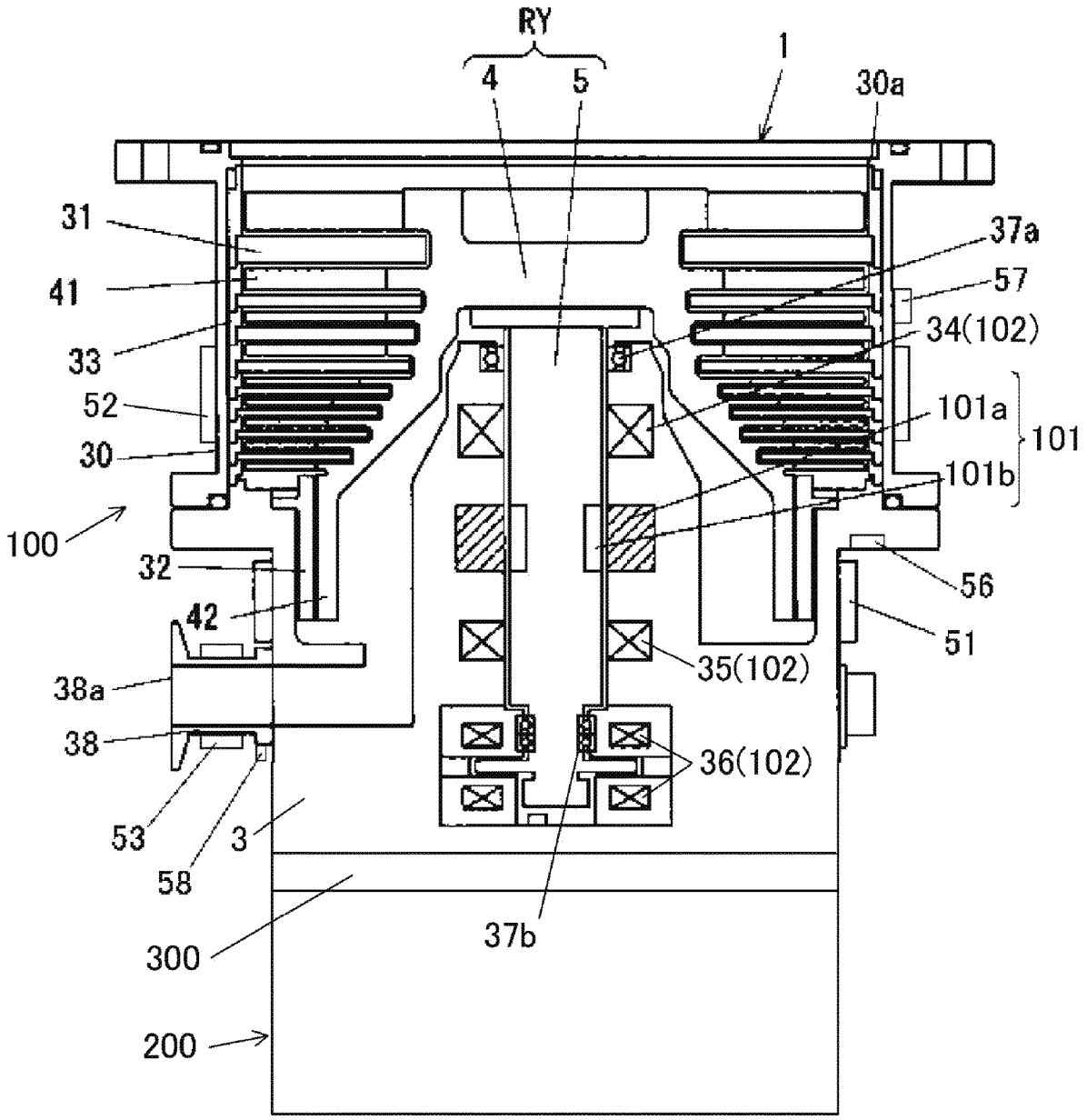
FIG. 1 is a view of a turbo-molecular pump as an example of a vacuum pump.

FIG. 1 is a view of a turbo-molecular pump as an example of a vacuum pump of the present embodiment. The turbo-molecular pump 1 includes a pump device 100 configured to perform vacuum pumping, and a control unit 200 configured to drivably control the pump device 100. The control unit 200 can be also referred to as a "power source device 200." The turbo-molecular pump 1 of a first embodiment is a power source device-integrated vacuum pump configured such that the pump device 100 and the control unit 200 are integrated together. A cooling device 300 is interposed between the pump device 100 and the control unit 200. The cooling device 300 is configured to use coolant water introduced into the cooling device 300, thereby cooling heat generation elements forming the control unit 200.

The pump device 100 has a turbo pump stage including rotor blades 41 and stationary blades 31, and a drag pump stage (a screw groove pump stage) including a cylindrical portion 42 and a stator 32. In the screw groove pump stage, the stator 32 or the cylindrical portion 42 is provided with a screw groove. The rotor blades 41 and the cylindrical portion 42 are formed at a pump rotor 4. The pump rotor 4 is fastened to a shaft 5. The pump rotor 4 and the shaft 5 form a rotor unit RY.

The stationary blades 31 and the rotor blades 41 are alternately arranged in an axial direction. Each stationary blade 31 is placed on a base 3 through spacer rings 33. When a pump case 30 is fixed to the base 3 with bolts, the stack of the spacer rings 33 is sandwiched between the base 3 and a lock portion 30*a* of the pump case 30, and therefore, the positions of the stationary blades 31 are determined. The base 3 is provided with an exhaust pipe 38, the exhaust pipe 38 having an exhaust port 38*a*.

The turbo-molecular pump 1 illustrated in FIG. 1 is a magnetic levitation type turbo-molecular pump, and the rotor unit RY is non-contact supported by magnetic bearings 34, 35, 36 provided at the base 3. The magnetic bearings 34, 35, 36 form a magnetic bearing device 102.

The rotor unit RY is rotatably driven by a pump motor 101. The pump motor 101 will be also referred to as a "motor 101." The motor 101 has a stator 101*a* and a rotor 101*b*. When the magnetic bearings are not in operation, the rotor unit RY is supported by emergency mechanical bearings 37*a*, 37*b*.

Generally in a turbo-molecular pump, e.g., a base and an exhaust pipe are heated by heaters for reducing accumulation of a reaction product. In the turbo-molecular pump 1 of the first embodiment, a heater 52 configured to control the temperature of each stationary blade 31 is provided at the outer periphery of the pump case 30. A heater 51 configured to control the temperature of the base 3 is provided at the outer periphery of the base 3. A heater 53 configured to control the temperature of the exhaust pipe 38 is provided at the outer periphery of the exhaust pipe 38. The temperature of the base 3 is detected by a temperature sensor 56, the temperature of the pump case 30 (each stationary blade 31) is detected by a temperature sensor 57, and the temperature of the exhaust pipe 38 is detected by a temperature sensor 58. A detection result from each temperature sensor 56, 57, 58 is input to the control unit 200.

Note that the pressure of gas exhausted from the exhaust pipe 38 is highest in the turbo-molecular pump 1, and the sublimation temperature of an impurity in gas sucked into the turbo-molecular pump 1 is highest. For this reason, in the turbo-molecular pump 1 of the first embodiment, the heating temperature of the heater 53 attached to the exhaust pipe 38 is set higher than those of other heaters 51, 52. Thus, an alternating current heater (hereinafter referred to as an "AC heater") configured to be driven with an AC of 200 V is employed as the heater 53 so that the exhaust pipe 38 can be heated to a higher temperature.

Figure 2A:
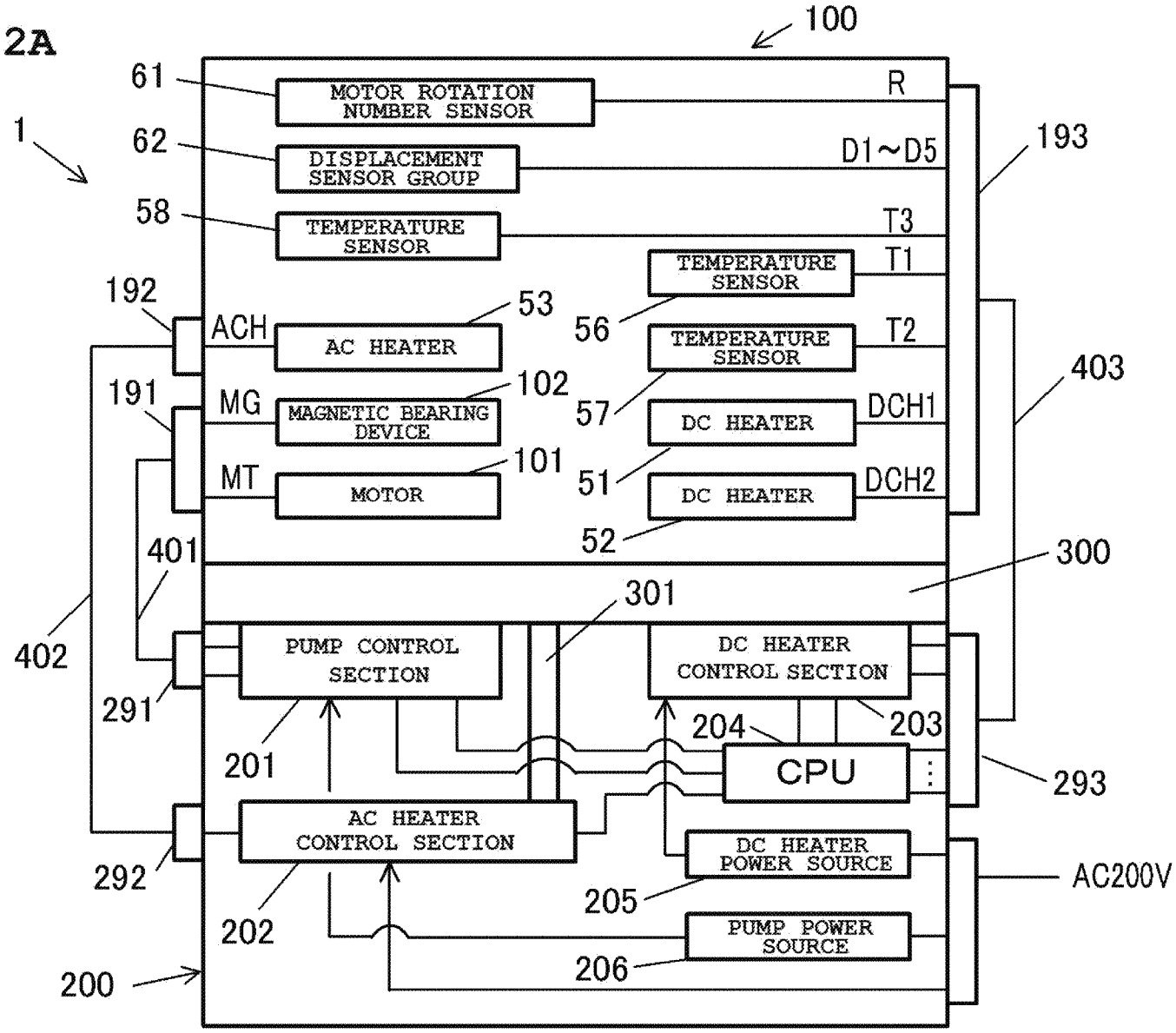
FIG. 2A is a diagram of a configuration of a turbo-molecular pump 1.
Figure 2B:
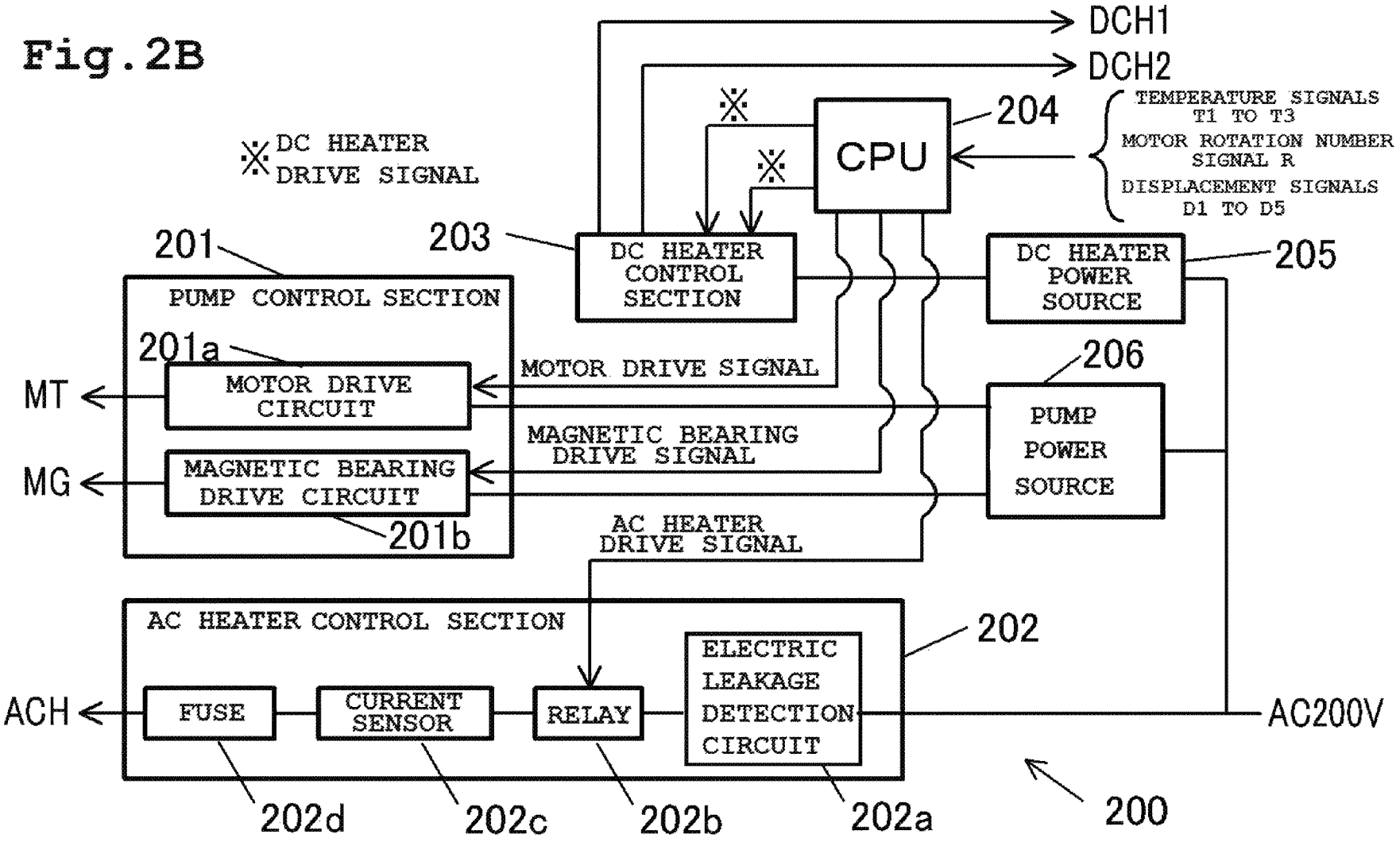
FIG. 2B is a diagram of a configuration of a power source device of the turbo-molecular pump.

The power source device-integrated vacuum pump of the first embodiment will be described in more detail with reference to FIGS. 1, 2A, and 2B. FIG. 2A is a diagram of a configuration of the turbo-molecular pump 1, and FIG. 2B is a diagram of a configuration of the power source device 200 of the turbo-molecular pump 1.

The turbo-molecular pump 1 has the pump device 100 and the power source device 200 integrated with the pump device 100.

The pump device 100 has the motor 101, the magnetic bearing device 102, the two direct current heaters (hereinafter referred to as "DC heaters") 51, 52, the AC heater 53 using an AC 200 V power source, a rotation number sensor 61 configured to detect the number of rotations of the motor, a five-axis displacement sensor group 62 configured to detect displacement of the magnetic bearings, and the temperature sensors 56, 57, 58.

The power source device 200 includes a pump control section 201 configured to drivably control the motor 101 and the magnetic bearing device 102, an AC heater control section 202 configured to drive the AC heater 53 with an AC of 200 V, a DC heater control section 203 configured to drive the DC heater with a DC of 48 V, a CPU 204, a DC heater power source 205, and a pump power source 206. The power sources 205, 206 each include AC/DC converters, and are each configured to step down an AC of 200 V to output DC voltage.

As illustrated in FIG. 2B, the pump control section 201 has a motor drive circuit 201*a* and a magnetic bearing drive circuit 201*b*. The motor drive circuit 201*a* is configured to control drive power MT for the motor 101. The magnetic bearing drive circuit 201*b* is configured to control drive power MG for the magnetic bearing device 102. The motor 101, the magnetic bearing device 102, and the pump control section 201 are connected together through a connector 191 provided at the pump device 100, a connector 291 provided at the power source device 200, and a cable 401 connecting between the two connectors 191, 291.

The AC heater control section 202 has an electric leakage detection circuit 202*a* connected to an AC 200 V high-power line, a relay 202*b*, a current sensor 202*c*, and a fuse 202*d*. The AC heater control section 202 is configured to control heater drive power ACH to be supplied to the AC heater 53. The AC heater 53 and the AC heater control section 202 are connected together through a connector 192 provided at the pump device 100, a connector 292 provided at the power source device 200, and a cable 402 connecting between the two connectors 192, 292.

The DC heater control section 203 has not-shown two FETs configured to control heater drive power DCH1, DCH2 to be supplied to the two DC heaters 51, 52, and not-shown two shunt resistors for current detection. The DC heaters 51, 52 and the DC heater control section 203 are connected together through a connector 193 provided at the pump device 100, a connector 293 provided at the power source device 200, and a cable 403 connecting between the two connectors 193, 293.

The pump control section 201 and the DC heater control section 203 are arranged in contact with a metal plate at a lower surface of the cooling device 300. The AC heater control section 202 thermally contacts the lower surface of the cooling device 300 through a heat sink 301 as a heat transfer member, and generated heat is cooled by the cooling device 300 through the heat sink 301.

Temperature signals T1 to T3 from the temperature sensors 56 to 58 of the pump device 100, a motor rotation number signal R from the rotation number sensor 61, and five-axis displacement signals Dl to D5 from the displacement sensor group 62 are input to the CPU 204. Based on these input signals, the CPU 204 generates drive signals for driving the motor 101, the magnetic bearing device 102, the DC heaters 51, 52, and the AC heater 53, thereby performing ON/OFF control of switching elements. A motor drive signal is output to the motor drive circuit 201*a*, and ON/OFF control of a switching transistor configured to control rotation of the motor 101 is performed. A magnetic bearing drive signal is output to the magnetic bearing drive circuit 201*b*, and ON/OFF control of a switching transistor configured to control repulsion force and attraction force of the magnetic bearings is performed. An AC heater drive signal is input to the AC heater control section 202, and ON/OFF control of the relay 202*b* is performed such that a portion to be heated by the AC heater 53 is held at a predetermined temperature. In this manner, the heater drive power ACH to be supplied to the AC heater 53 is controlled. A DC heater drive signal is input to the DC heater control section 203, and ON/OFF control of the not-shown FETs is performed such that portions to be heated by the DC heaters 51, 52 are held at predetermined temperatures. In this manner, the heater drive power DCH1, DCH2 to be supplied to the DC heaters 51, 52 is controlled.

The temperature sensors 56 to 58, the rotation number sensor 61, the displacement sensor group 62, and the CPU 204 are connected together through the connector 193 provided at the pump device 100, the connector 293 provided at the power source device 200, and the cable 403 connecting between the two connectors 193, 293.

In the vacuum pump configured as described above, the pump device 100 is, for preventing accumulation of the reaction product, provided with the two DC heaters 51, 52 and the single AC heater 53. The DC heater control section 203 as a circuit configured to drivably control the DC heaters 51, 52 does not require large elements as in the AC heater control section 202 as a circuit configured to drivably control the AC heater 53, and therefore, a plurality of small semiconductor switches such as FETs may be provided. Thus, the DC heater control section 203 is smaller than the AC heater control section 202. Consequently, the power source device 200 can be downsized as compared to a power source device of a vacuum pump provided with three AC heaters, and can be placed integrally with the case or base of the pump device 100.

According to the above-described vacuum pump of the first embodiment, the following features and advantageous effects can be provided.

(1) The vacuum pump of the first embodiment includes the pump device 100 having the pump motor 101, an exhaust function section configured to exhaust sucked gas, the two direct current heaters 51, 52, and the single alternating current heater 53; and the pump-integrated power source device 200 having the pump control section 201, the pump power source 206 configured to supply power to the pump control section 201, the direct current heater control section 203 configured to control the two direct current heaters 51, 52, the direct current heater power source configured to supply power to the direct current heater control section 203, and the alternating current heater control section 202 configured to control the alternating current heater 53.

As described above, the vacuum pump of the first embodiment requires three heaters. Since two of these three heaters are the direct current heaters, the power source device can be downsized as compared to the case of using alternating current heaters as all of the three heaters.

(2) The vacuum pump of the first embodiment has a pump housing 30 forming the pump device, a power source device housing forming the power source device 200, and the cooling device 300 interposed between the pump housing 30 and the power source device housing. The pump control section 201 and the direct current heater control section 203 are attached to the cooling device 300.

The pump control section 201 and the direct current heater control section 203 are directly cooled by the cooling device 300, and therefore, circuit heat generation in the power source device can be reduced.

First Variation of First Embodiment

Figure 3:
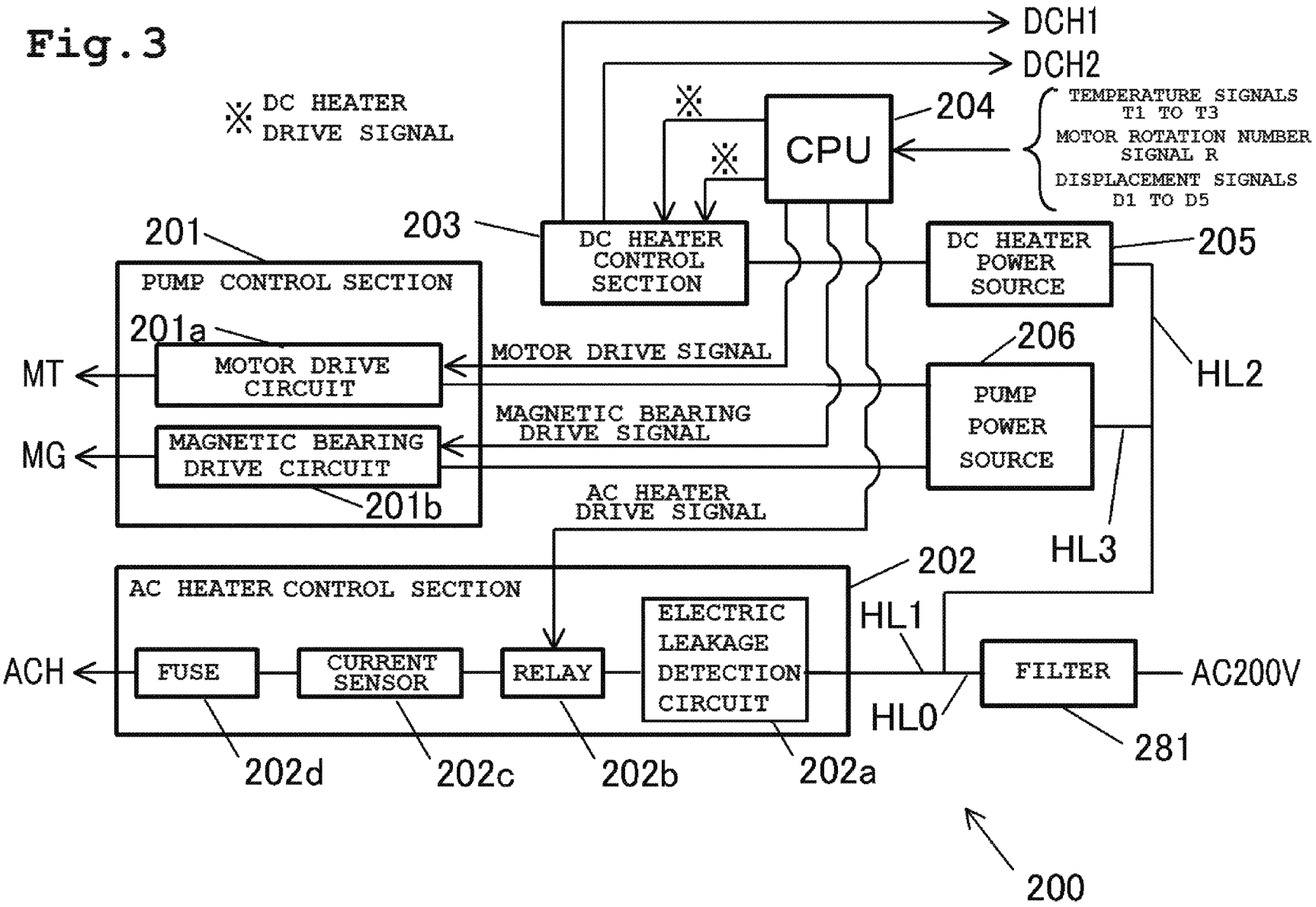
FIG. 3 is a diagram of a configuration of a power source device in a first variation of the turbo-molecular pump.

A first variation of the power source device-integrated vacuum pump of the first embodiment will be described with reference to FIG. 3. FIG. 3 is a diagram of the configuration of the power source device 200 in the first variation of the turbo-molecular pump 1.

In the first variation, a filter 281 is provided at a high-power line HC0 common to a high-power line HL1 for supplying alternating current power to the AC heater control section 202, a high-power line HL2 for supplying alternating current power to the DC heater power source 205, and a high-power line HL3 for supplying alternating current power to the pump power source 206. The filter 281 is a power source EMC filter for reducing noise entered or leaking through an AC 200 V power source line.

(1) In the vacuum pump of the first variation of the first embodiment, the filter 281 is provided at the line HC0 common to three power sources for supplying an AC of 200 V. Thus, it is not necessary to separately provide filters at these three power sources, and therefore, a small power source device can be configured.

Second Variation of First Embodiment

Figure 4A:
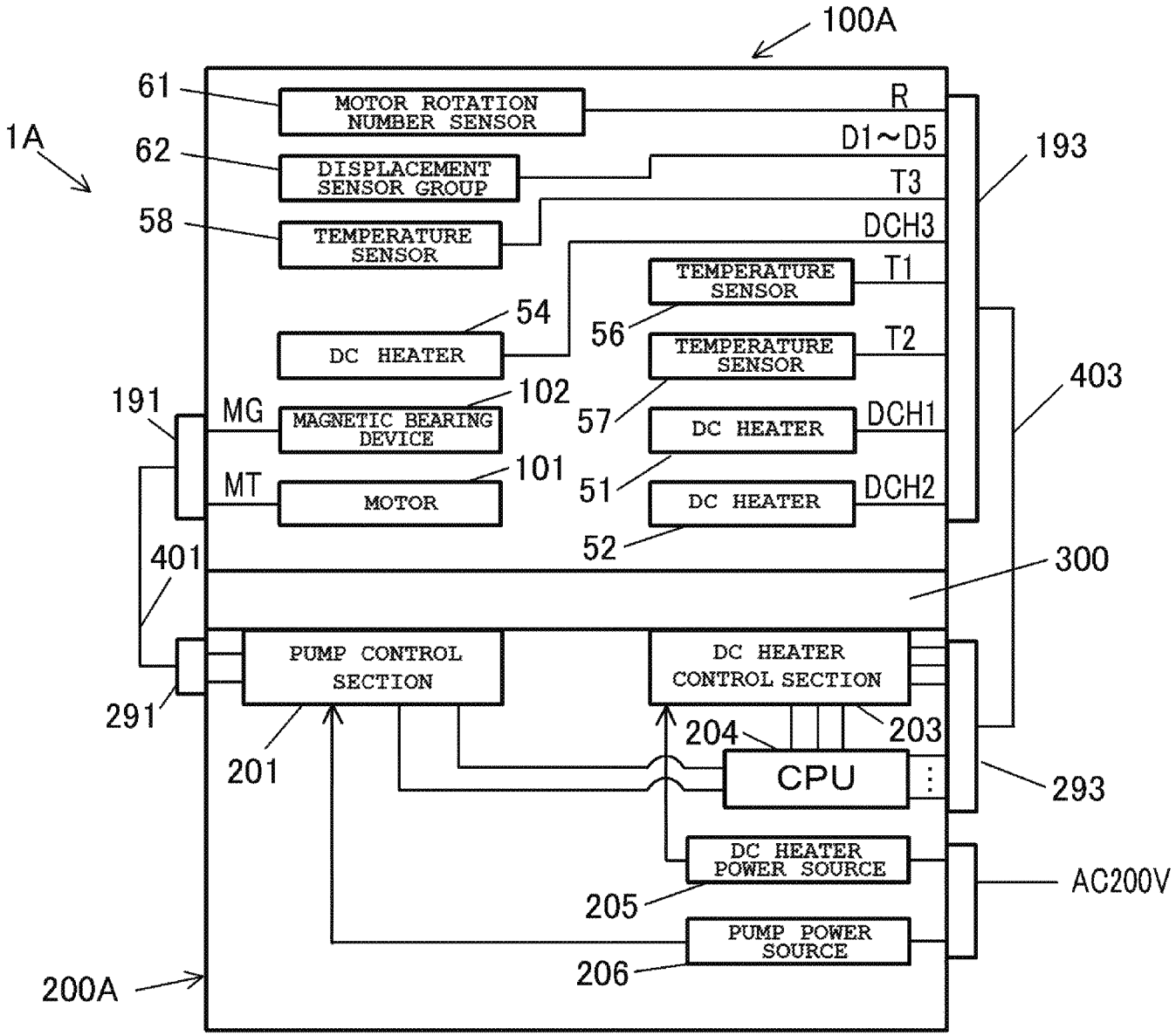
FIG. 4A is a diagram of a configuration of a turbo-molecular pump of a second variation.
Figure 4B:
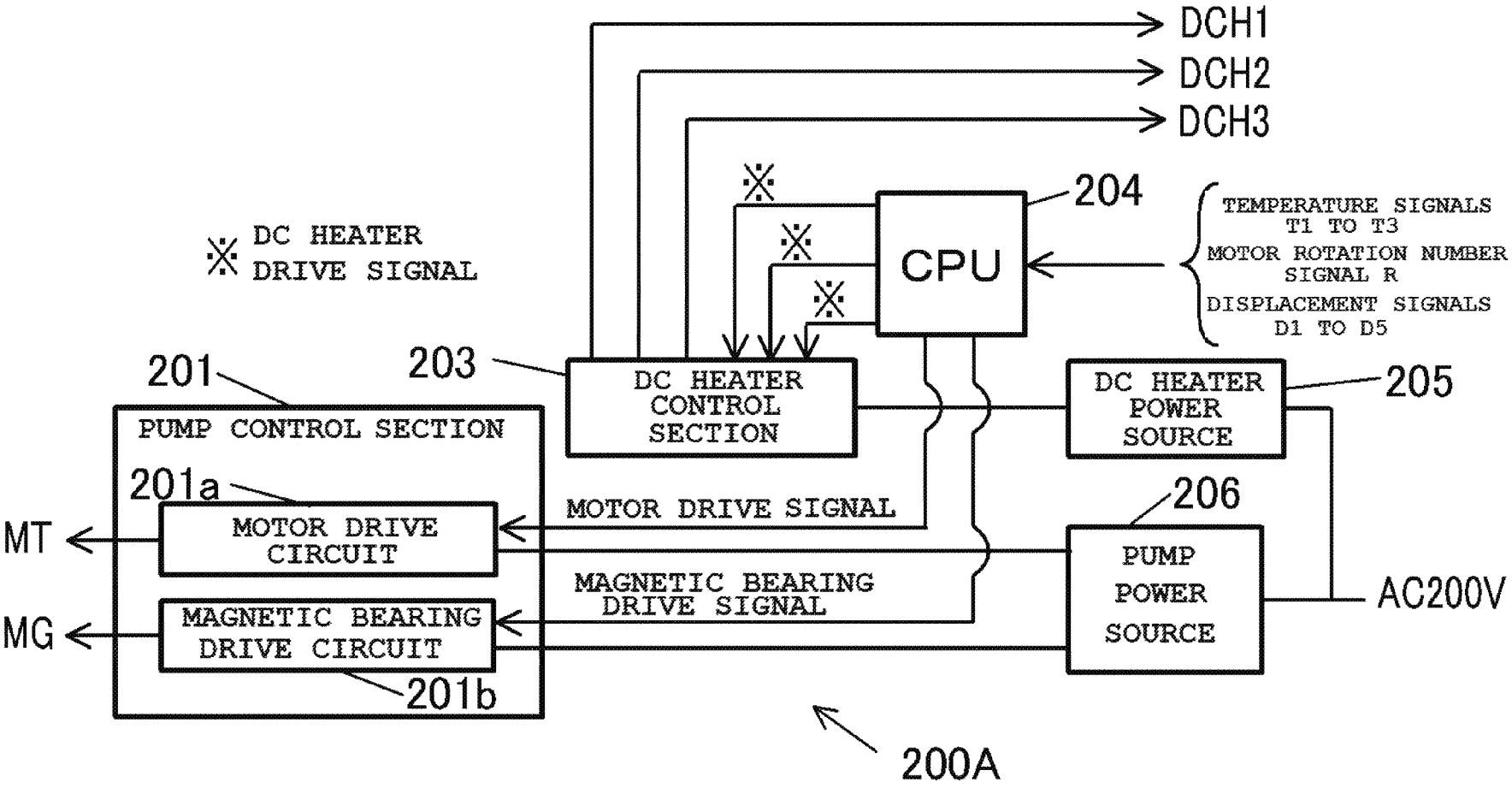
FIG. 4B is a diagram of a configuration of a power source device 200A of a turbo-molecular pump 1A of the second variation.

A second variation of the power source device-integrated vacuum pump of the first embodiment will be described with reference to FIGS. 4A and 4B. FIG. 4A is a diagram of a configuration of a turbo-molecular pump 1A, and FIG. 4B is a diagram of a configuration of a power source device 200A of the turbo-molecular pump 1A.

In the second variation, a DC heater 54 configured to be driven with a DC of 48V is, instead of the AC heater 53 configured to be driven with an AC of 200 V, used as the heater configured to heat the exhaust pipe 38 (see FIG. 1). That is, the AC heater is replaced with the DC heater, and therefore, the present invention is also applicable to a vacuum pump using three DC heaters.

In the second variation, the AC heater control section 202 is omitted. The DC heater control section 203 has not-shown three FETs configured to control heater drive power DCH1, DCH2, DCH3 to be supplied to the three DC heaters 51, 52, 54, and not-shown three shunt resistors for current detection.

(1) In the vacuum pump of the second variation of the first embodiment, all of the three heaters are the direct current heaters, and therefore, the power source device 200A can be further downsized as compared to the power source device 200 of the first embodiment.

Second Embodiment

A second embodiment of a power source device-integrated vacuum pump will be described with reference to FIGS. 5A and 5B. In description below, the same reference numerals as those of the second variation of the first embodiment are used to represent equivalent elements, and differences will be mainly described. Points which will not be specifically described are the same as those of the second variation of the first embodiment.

Figure 5A:
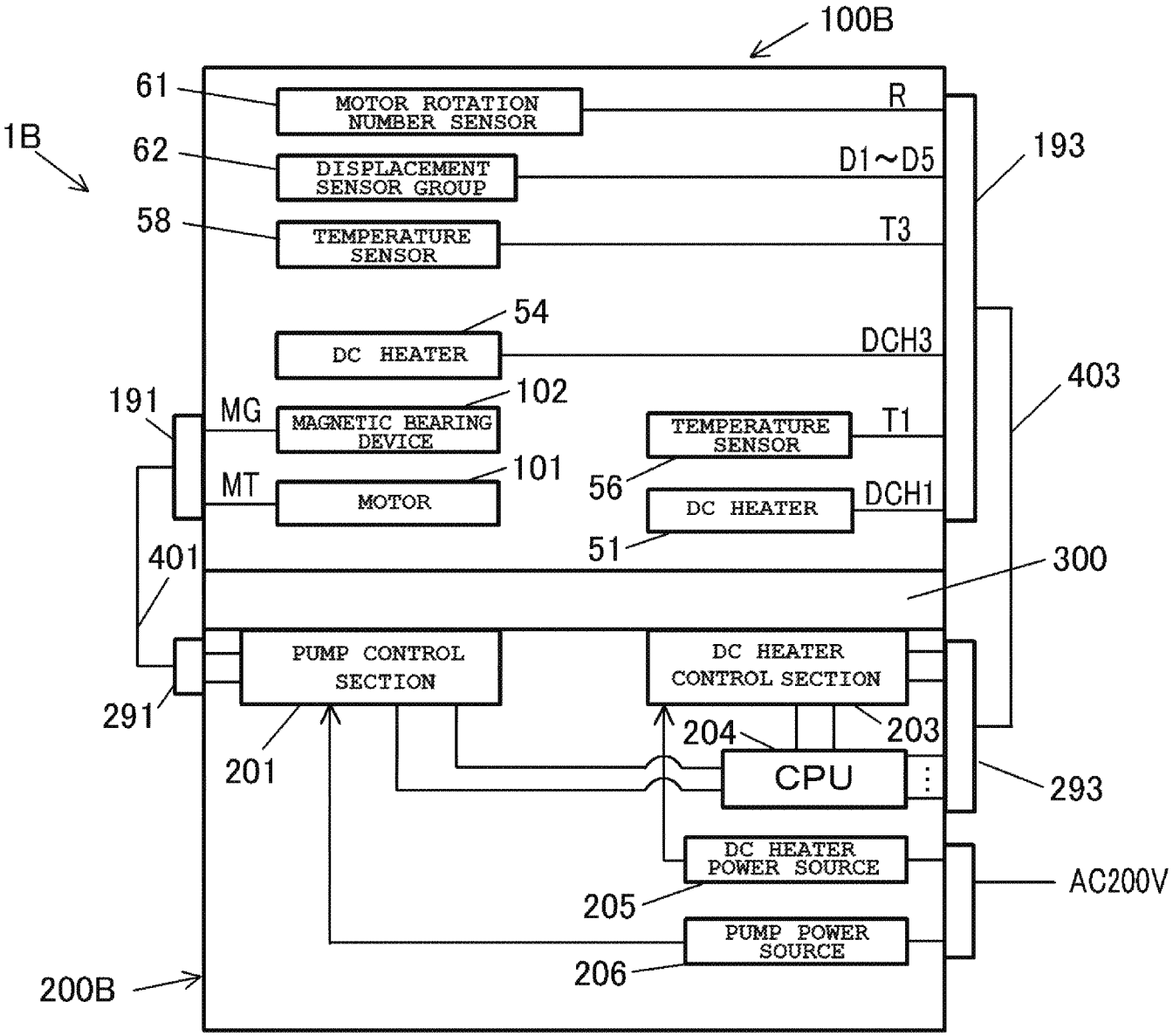
FIG. 5A is a diagram of a configuration of a turbo-molecular pump of a second embodiment.
Figure 5B:
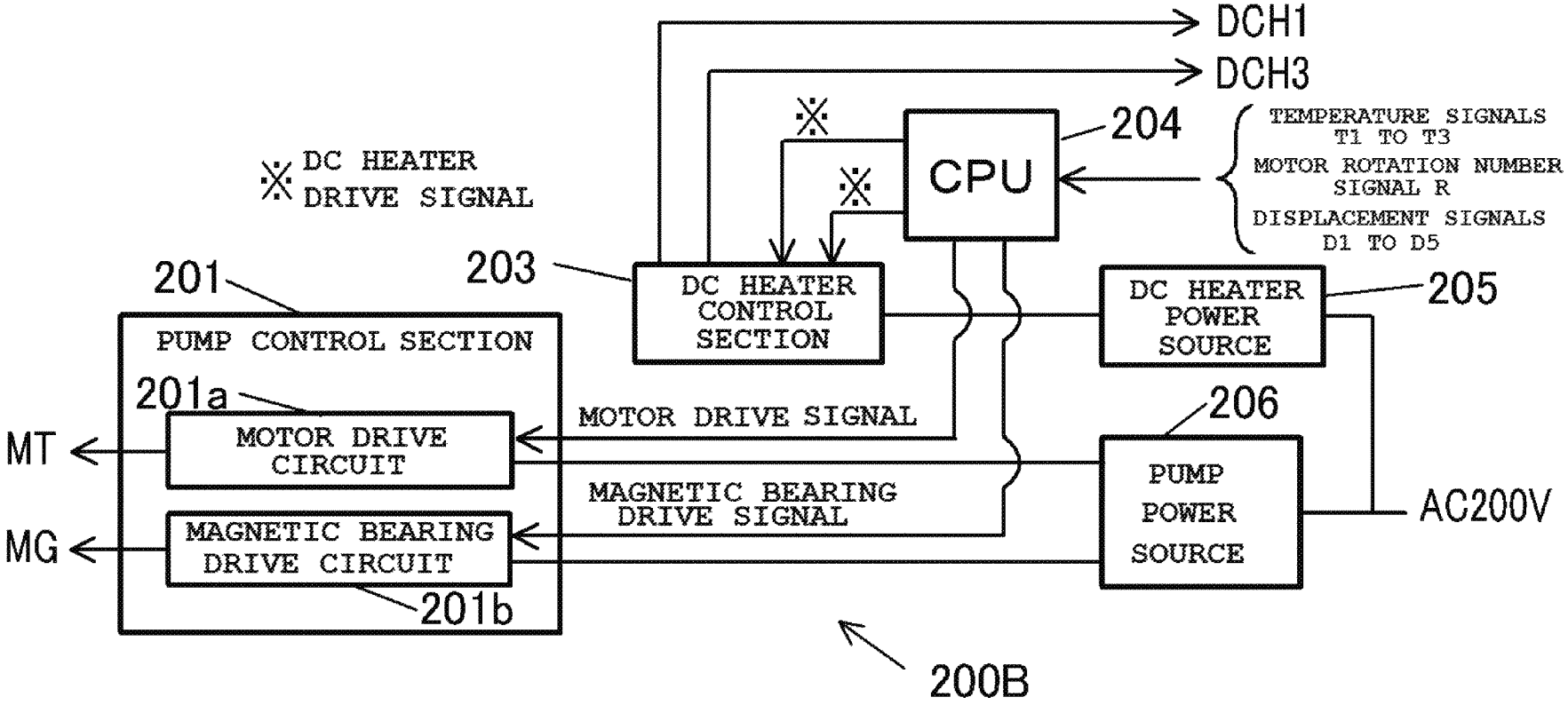
FIG. 5B is a diagram of a configuration of a power source device of the turbo-molecular pump of the second embodiment.

FIG. 5A is a diagram of a configuration of a turbo-molecular pump 1B of the second embodiment, and FIG. 5B is a diagram of a configuration of a power source device 200 of the turbo-molecular pump 1B. The power source device-integrated vacuum pump of the second embodiment is configured such that the DC heater 52 is omitted from the turbo-molecular pump LA of the second variation of the first embodiment described above. That is, in the turbo-molecular pump 1B of the second embodiment, a pump device 100B is provided with two DC motors 51, 54.

The power source device 200B of the second embodiment includes a pump control section 201, a DC heater control section 203, a CPU 204, a DC heater power source 205, and a pump power source 206. The DC heater control section 203 has not-shown two FETs configured to control heater drive power DCH1, DCH3 to be supplied to the two DC heaters 51, 54, and not-shown two shunt resistors for current detection.

(1) In the case of requiring only two heaters, direct current heaters are used as these two heaters as in the vacuum pump of the second embodiment, and therefore, the power source device can be downsized as compared to the case of using two alternating current heaters.

Various embodiments and the variations have been described above, but the present invention is not limited to these contents. Other aspects conceivable within the scope of the technical idea of the present invention are also included in the scope of the present invention. For example, the cooling device is not essential for the present invention. One aspect of the present invention relates to the vacuum pump, and other aspects of the present invention relate to the above-described power source device.

What is claimed is:

1. A vacuum pump comprising:

a pump motor, an exhaust configured to exhaust sucked gas, and at least two direct current heaters; and a pump-integrated power controller including a pump controller, a pump power source configured to supply power to the pump controller, a direct current heater controller configured to control the at least two direct current heaters, and only one dedicated direct current heater power source provided separately from the pump power source and configured to supply power to the direct current heater controller.

2. The vacuum pump according to claim 1, further comprising:

a pump housing;

a power controller housing forming the power controller; and a cooling device interposed between the pump housing and the power controller housing, wherein the pump controller and the direct current heater controller are attached to the cooling device.

3. The vacuum pump according to claim 1, wherein in addition to the at least two direct current heaters, the vacuum pump is further provided with one or more direct current heaters.

4. The vacuum pump according to claim 1, wherein the vacuum pump further includes a stationary blade, a pump case and a base, and the at least two direct current heaters are a heater configured to control a temperature of the stationary blade and provided at an outer periphery of the pump case, and a heater configured to control a temperature of the base and provided at an outer periphery of the base.

5. The vacuum pump according to claim 1, wherein the direct current heater controller has two field-effect transistors (FETs) configured to control a heater drive power to be supplied to the at least two direct current heaters, and two shunt resistors for current detection.

6. The vacuum pump according to claim 5, wherein the at least two direct current heaters and the direct current heater controller are connected together through a connector provided at the vacuum pump, a connector provided at the pump-integrated power controller, and a cable connecting between the two connectors.

7. A vacuum pump comprising:

a pump motor, an exhaust configured to exhaust sucked gas, and at least two direct current heaters; and a pump-integrated power controller including a pump controller, a pump power source configured to supply power to the pump controller, a direct current heater controller configured to control the at least two direct current heaters, and a direct current heater power source configured to supply power to the direct current heater controller, wherein the vacuum pump further includes an alternating current heater, and the power controller includes an alternating current heater controller configured to control the alternating current heater.

8. The vacuum pump according to claim 7, wherein a noise filter is provided at a common high-power line connected to a first high-power line for supplying power to the alternating current heater controller, a second high-power line for supplying power to the pump power source, and a third high-power line for supplying power to the direct current heater power source.

9. The vacuum pump according to claim 7, wherein the vacuum pump further includes an exhaust pipe, and the alternating current heater is a heater configured to control a temperature of the exhaust pipe and provided at an outer periphery of the exhaust pipe.

10. The vacuum pump according to claim 9, wherein the vacuum pump further includes a stationary blade, a pump case and a base, and the at least two direct current heaters are a heater configured to control a temperature of the stationary blade and provided at an outer periphery of the pump case, and a heater configured to control a temperature of the base and provided at an outer periphery of the base.

11. The vacuum pump according to claim 10, wherein a heating temperature of the heater attached to the exhaust pipe is set higher than a heating temperature of the heater attached to the pump case and a heating temperature of the heater attached to the base.

12. The vacuum pump according to claim 7, wherein the alternating current heater controller has an electric leakage detection circuit connected to an alternating current high-power line, a relay, a current sensor, and a fuse.

13. A pump-integrated power controller for a pump including a pump motor, an exhaust configured to exhaust sucked gas, and at least two direct current heaters, the pump-integrated power controller comprising:

a pump controller, a pump power source configured to supply power to the pump controller, a direct current heater controller configured to control the at least two direct current heaters, and only one dedicated direct current heater power source provided separately from the pump power source and configured to supply power to the direct current heater controller.

* * * * *